US010919253B2

(12) United States Patent
Kumar et al.

(10) Patent No.: US 10,919,253 B2
(45) Date of Patent: Feb. 16, 2021

(54) QUILLING DEVICE

(71) Applicants: Ravi Kumar, Mumbai (IN); Disha Katharani, Mumbai (IN)

(72) Inventors: Ravi Kumar, Mumbai (IN); Disha Katharani, Mumbai (IN)

( * ) Notice: Subject to any disclaimer, the term of this patent is extended or adjusted under 35 U.S.C. 154(b) by 225 days.

(21) Appl. No.: 15/950,159

(22) Filed: Apr. 10, 2018

(65) Prior Publication Data

US 2018/0229465 A1 Aug. 16, 2018

Related U.S. Application Data

(63) Continuation-in-part of application No. 15/514,800, filed as application No. PCT/IB2016/051735 on Mar. 26, 2016.

(30) Foreign Application Priority Data

Mar. 25, 2015 (IN) ..... 993/MUM/2015
Dec. 4, 2017 (IN) ..... 201721043382

(51) Int. Cl.
*B31C 11/02* (2006.01)
*B44C 5/00* (2006.01)
*B31C 99/00* (2009.01)

(52) U.S. Cl.
CPC ..... *B31C 11/02* (2013.01); *B31C 13/00* (2013.01); *B44C 5/00* (2013.01)

(58) Field of Classification Search
CPC ..... B31C 11/02; B31C 99/01; B31C 13/00; B25F 1/02; B25F 3/00; B44C 5/00
USPC ..... 493/436
See application file for complete search history.

(56) References Cited

U.S. PATENT DOCUMENTS 2,168,465 A * 8/1939 Amrhein ..... B65H 75/06 493/276
3,779,474 A * 12/1973 Harelson ..... H01F 41/063 242/444.1
3,934,834 A * 1/1976 Gick ..... B65H 18/10 242/532.6
4,166,488 A * 9/1979 Irby ..... B23B 31/005 81/177.85
4,191,341 A * 3/1980 Looser ..... B65H 18/16 242/541.4
5,054,707 A * 10/1991 Olson ..... B65H 19/2215 242/533.5
5,248,107 A * 9/1993 Sumida ..... B65H 19/2246 242/524.1
5,421,536 A * 6/1995 Hertel ..... B65H 19/2269 242/526.1
5,524,843 A * 6/1996 McCauley ..... B65H 18/10 242/532.6

(Continued)

*Primary Examiner* — Anna K Kinsaul
*Assistant Examiner* — Daniel Jeremy Leeds
(74) *Attorney, Agent, or Firm* — Maschoff Brennan

(57) ABSTRACT

An apparatus for coiling a paper strip is disclosed. The apparatus includes a housing, a pin and a plunger. The pin having an end positioned external to the housing and an axis of rotation, the end having a slot elongated along the axis of rotation, the slot being sized to receive the paper strip. Further, the plunger is disposed on the housing and configured to translate away from the pin, the plunger having a plunger head positioned proximate to the slot of the pin, the plunger head having a surface aligned to press the paper strip against the pin.

7 Claims, 11 Drawing Sheets

(56) References Cited

U.S. PATENT DOCUMENTS

| | | | | |
|---|---|---|---|---|
| 6,003,421 | A * | 12/1999 | Milich | B26D 1/045 242/527.4 |
| 8,905,153 | B2 | 12/2014 | Braun et al. | |
| 2011/0095126 | A1* | 4/2011 | Bartkowski | B31C 13/00 242/548.2 |
| 2011/0308696 | A1* | 12/2011 | Suskin | B31C 7/00 156/63 |
| 2016/0023421 | A1* | 1/2016 | Ludwig | B65H 75/30 242/532.6 |

* cited by examiner

QUILLING DEVICE

CROSS-REFERENCE TO RELATED APPLICATIONS

This application is a continuation-in-part of U.S. patent application Ser. No. 15/514,800, filed on Mar. 27, 2017, which takes priority for Indian Provisional Application No. 993/MUM/2015, filed on Mar. 25, 2015. This application also claims priority to Indian Provisional Application No. 201721043382, filed on Dec. 4, 2017, and titled 'Coiling Apparatus.' The disclosures of all above-identified patent documents are incorporated by reference as if fully set forth in detail herein.

FIELD OF THE DISCLOSURE

The present disclosure generally relates to quilling devices and more particularly to a coiling apparatus for coiling paper.

BACKGROUND TO THE DISCLOSURE

Paper quilling involves the use of strips of paper. Typically, the paper strips are rolled into coils, twisted, manipulated and glued for creating an artistic work in two or three dimensions. A typical quilling work may require 20 to 100 coils or more.

Over the years, several manual and automated quilling tools have been used to make paper quills or coils. In both manual and automated quilling tools, the user has to hold on to the point on the paper strip where the coil is being formed in order to guide the formation of the coil. Further, if the angle of the paper strip changes during the process of coiling, then the resulting coil may appear deformed. In other words, conventional quilling tools require manual effort to guide the paper strip to maintain a straight line and to prevent bending or twisting of the paper strip during coiling. Further, in conventional quilling tools there is no provision to apply glue to the paper strip during coiling.

SUMMARY OF THE DISCLOSURE

This summary is provided to introduce a selection of concepts in a simple manner that are further described in the detailed description of the disclosure. This summary is not intended to identify key or essential inventive concepts of the subject matter nor is it intended for determining the scope of the disclosure.

Briefly, according to an exemplary embodiment, an apparatus for coiling a paper strip is disclosed. The apparatus includes a housing, a pin and a plunger. The pin having an end positioned external to the housing and an axis of rotation, the end having a slot elongated along the axis of rotation, the slot being sized to receive the paper strip. Further, the plunger is disposed on the housing and configured to translate away from the pin, the plunger having a plunger head positioned proximate to the slot of the pin, the plunger head having a surface aligned to press the paper strip against the pin.

The summary above is illustrative only and is not intended to be in any way limiting. Further aspects, exemplary embodiments, and features will become apparent by reference to the drawings and the following detailed description.

BRIEF DESCRIPTION OF THE FIGURES

These and other features, aspects, and advantages of the exemplary embodiments can be better understood when the following detailed description is read with reference to the accompanying drawings in which like characters represent like parts throughout the drawings, wherein.

Figure 1A:
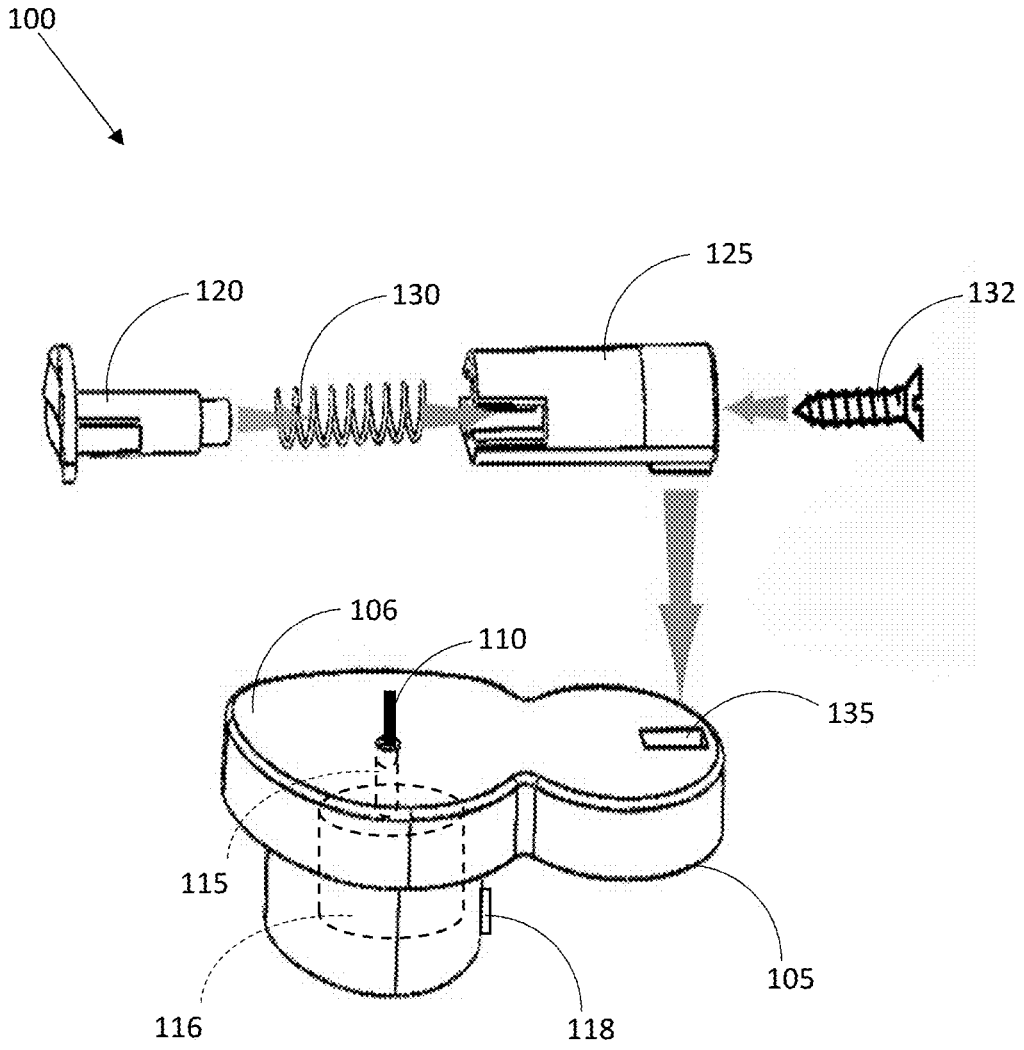
FIG. 1A illustrates arrangement of components of a coiling apparatus, in accordance with one embodiment of the present disclosure.

Further, persons skilled in the art to which this disclosure belongs will appreciate that elements in the figures are illustrated for simplicity and may not have been necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those of ordinary skill in the art having benefit of the description herein.

DETAILED DESCRIPTION OF THE DISCLOSURE

For the purpose of promoting an understanding of the principles of the invention, reference will now be made to the embodiments illustrated in the figures and specific language will be used to describe the same. It will nevertheless be understood that no limitation of the scope of the invention is thereby intended, such alterations and further modifications in the illustrated system, and such further applications of the principles of the invention as illustrated therein being contemplated as would normally occur to one skilled in the art to which the invention relates.

It will be understood by those skilled in the art that the foregoing general description and the following detailed description are exemplary and explanatory of the invention and are not intended to be restrictive thereof.

The terms "comprises", "comprising", or any other variations thereof, are intended to cover a non-exclusive inclusion, such that a process or method that comprises a list of steps does not comprise only those steps but may comprise other steps not expressly listed or inherent to such process or method. Similarly, one or more devices or sub-systems or elements or structures or components proceeded by "comprises . . . a" does not, without more constraints, preclude the existence of other devices or other sub-systems or other elements or other structures or other components or additional devices or additional sub-systems or additional elements or additional structures or additional components. Appearances of the phrase "in an embodiment", "in another embodiment" and similar language throughout this specification may, but do not necessarily, all refer to the same embodiment.

Unless otherwise defined, all technical and scientific terms used herein have the same meaning as commonly understood by one of ordinary skill in the art to which this invention belongs. The system, methods, and examples provided herein are illustrative only and not intended to be limiting.

The present disclosure discloses an apparatus for coiling strips of paper. The apparatus overcomes the disadvantages associated with manual or automated quilling tools. In particular, the coiling apparatus disclosed herein avoids the need for holding the paper manually during the coiling operation.

At least one exemplary embodiment is generally directed towards an apparatus for coiling a paper strip is disclosed. The apparatus includes a housing, a pin and a plunger. The pin having an end positioned external to the housing and an axis of rotation, the end having a slot elongated along the axis of rotation, the slot being sized to receive the paper strip. Further, the plunger is disposed on the housing and configured to translate away from the pin, the plunger having a plunger head positioned proximate to the slot of the pin, the plunger head having a surface aligned to press the paper strip against the pin.

Embodiments of the present disclosure will be described below in detail with reference to the accompanying figures.

Referring to FIGS. 1A, 1B, 1C and 1D, a coiling apparatus 100 for coiling a strip of paper is shown, in accordance with one embodiment of the present disclosure. The coiling apparatus essentially comprises a housing 105, a pin 110, a driving element 115 coupled to the pin 110, a motor 116 rotating the driving element 115, a plunger 120, and an enclosure 125. In addition, the coiling apparatus 100 may further comprise a screw 132 for holding together various components. The housing 105 provides a supporting platform for mounting the pin 110, the driving element 115, the motor 116, and the enclosure 125. In some embodiments, the pin 110 extends from a surface 106 on which the enclosure 125 is attached.

Optionally, a spring may be used to provide a biasing force that maintains the contact between the plunger 120 and the paper strip that winds around the pin 110. The biasing force counteracts the pushing action caused by the growing coil of paper strip around the pin 110. In one arrangement, the biasing element may apply a biasing to bias the plunger 120 toward the pin 110. For example, a compression spring 130 may be used as a biasing element. In other embodiments, other types of springs (e.g., leaf spring or coiled spring) may be used as a biasing element. In still other embodiments, an elastic body, such as a sponge or rubber element, may be used as a biasing element. In still other embodiments, a pressurized fluid, such as a liquid or a gas, may be used to supply the biasing force. It should be noted, however, that a biasing element may not be required in certain embodiments.

The driving element 115 may be rotated using the motor 116, which may be an electrical unit powered by a suitable power source (not shown) and controlled by the switch 118. The motor 116 may be an AC or DC motor that outputs rotary power for rotating the driving element 115. In some embodiments, other rotary power sources may be used; e.g., a wound spring, a pneumatic power source, a hydraulic power source, etc. The electrical unit eliminates need of manual effort and thus provides an easy and efficient way for quilling a strip of paper.

Figure 1B:
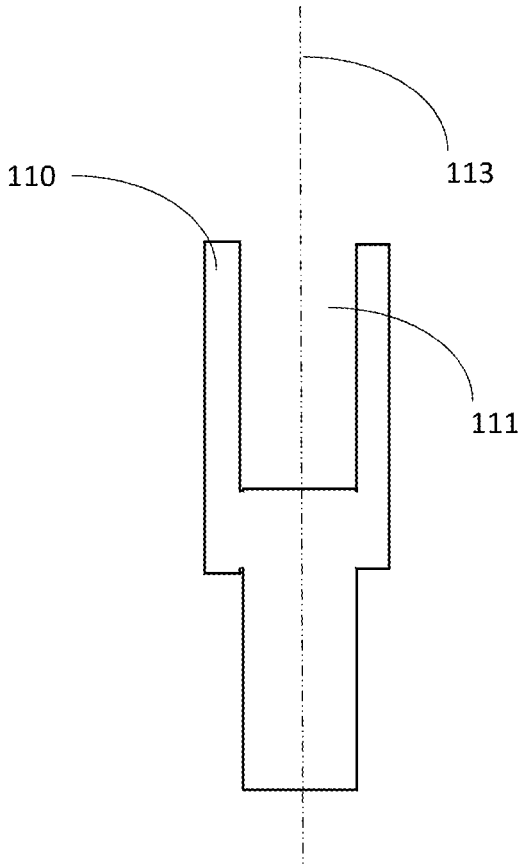
FIG. 1B illustrates a pin of the coiling apparatus, in accordance with one embodiment of the present disclosure.

As shown in FIG. 1B, the pin 110 is slotted. That is, the pin 110 has an axially aligned slot 111 that is configured to receive a quilling strip. By axially aligned, it is meant that the slot 111 is elongated along an axis 113 of rotation of the pin 110. The pin 110 is mounted vertically with respect to the surface of the housing 105 as shown in FIG. 1A. Further, the pin 110 is coupled via the driving element 115 to the motor 116 housed within the housing 105. Consequently, when the driving element 115 is rotated by the motor 116, the pin 110 also rotates. The user may manually actuate the switch 118 in order to cause rotation of the pin 110. It must be understood that the driving element 115 may refer to any mechanism that is capable of rotating the pin 110 upon actuation. Further, the pin 110 and the driving element 115, while described as a two features, may be one unitary body. For example, a single shaft or rod with a slotted end may extend from the motor 116 to outside of the housing 105. In other embodiments not shown, a gear drive to vary speed/torque may also be included along the drive structure conveying rotary power from the motor 116 to the pin 110.

Figure 1C:
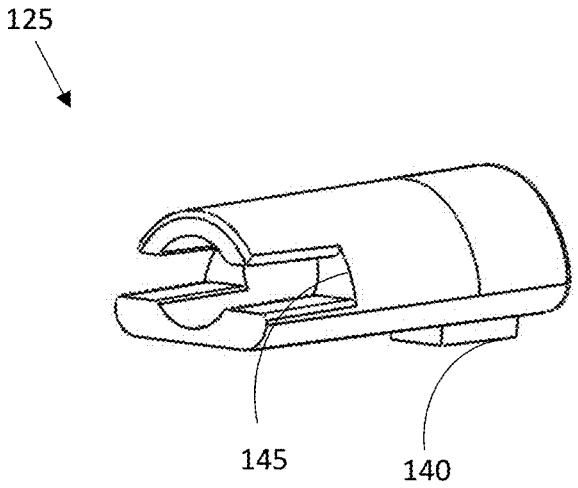
FIG. 1C illustrates a enclosure of the coiling apparatus, in accordance with one embodiment of the present disclosure.
Figure 1D:
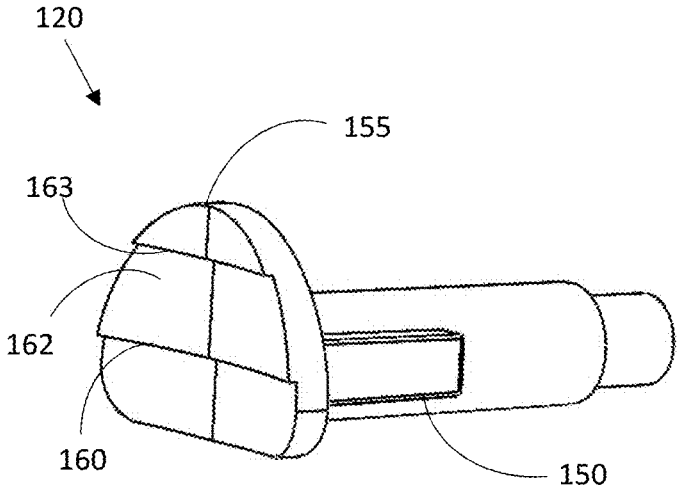
FIG. 1D illustrates a plunger of the coiling apparatus, in accordance with one embodiment of the present disclosure.

In one example, the housing 105 may comprise a groove 135 for mounting the enclosure 125. The enclosure 125 may have a protrusion 140 (as shown in FIG. 1C) that may be seated in the groove 135 on the housing 105 in order to fix the enclosure 125 onto the housing 105.

The plunger 120 is configured to hold a quilling strip steady as the quilling strip is being wound around the pin 110. The plunger 120 is disposed in the enclosure 125 from the one end such that, the plunger 120 slides relative to the enclosure 125. In other words, enclosure 125 provides a channel for translating the plunger 120 toward and away from the pin 110. The translating motion is generally transverse (perpendicular) to the axis of rotation 113 of the pin 110. In one embodiment, the enclosure 125 may have a rectangular slot 145 as shown in FIG. 1C. Further, the plunger 120 may have a protuberance 150 that may slide through the rectangular slot 145. In addition to guiding the movement of the plunger 120, the protuberance 150 also prevents the radial movement of the plunger 120 within the enclosure 125. Further, the end of the plunger 120 outside the enclosure 125 is attached to a plunger head 155.

In one embodiment, the plunger head 155 comprises one or more steps 160 formed on a surface 162 that faces the pin 110. The surface 162 is aligned such that the paper can be captured between the surface 162 and the pin 110. Further, the surface 162 of the plunger head 155 is shaped such that when the paper strip is coiled on the pin 110, at least one of the steps 160 prevents the paper strip from uncoiling or moving upwards; e.g., along the axis of rotation 113 and away from the housing 105. That is, the step(s) 160 confines the strip of paper between an edge 163 defining the step 160 and that is aligned transverse to the pin 110 and the housing 105. In other words, the steps 160 on the plunger head 155 holds down the coiled paper strip against the housing 105. In one embodiment, the height of each step 160 may be selected based on the width of the paper strip used. For example, the steps may be designed for paper strips of width 5 mm and 10 mm.

The other end of the plunger 120 within the enclosure 125 is further attached to the compression spring 130. The free end of the compression spring 130 is fixed to the enclosure 125 using the screw 132. When a force is applied on the plunger head 155, the compression spring 130 is pressed against the closed end of the enclosure 125. In reaction, the compression spring 130 exerts a restoring force on the plunger 120. More specifically, the compression spring 130 provides the restoring force to the plunger 120 for pressing a paper strip against the pin 110 during coiling action. In alternate embodiments, a pneumatic or a hydraulic means is provided in the place of compression spring 130 to provide the required force to the plunger 120 for pressing the paper strip against the pin 110.

If the restoring force is too high, then during operation, the motor torque exerted by the pin 110 on the plunger head 155 may fail to compress the compression spring 130. As a result, the compression spring 130 prevents or jams the pin 110 from rotating and the paper coil may not be formed. Similarly, if the restoring force of the compression spring 130 is too low, then the plunger 120 may not be able to press and hold the paper coil firmly against the pin 110. As a result, the paper strip may fan upwards resulting in a deformed paper coil. In case the driving element 115 is a DC motor, the compression spring 130 and the DC motor are selected such that the motor torque of the DC motor 115 is just high enough to overcome the restoring force of the compression spring 130. In other words, the restoring force of the compression spring 130 is kept low enough to allow it to be pushed back by the motor torque exerted by the rotation of the pin 110. As similar balancing of applied rotary power and the plunger restoring force would be used if a different rotary power system is used, e.g., wind-up, pull-back, etc.

It should be understood that the plunger is susceptible to numerous variants. For example, the plunger head 155 may be external to the enclosure 125. That is a telescopic arrangement may be used wherein the plunger head 155 is formed as an outer cylinder that slides along an inner cylinder.

Figure 1E:
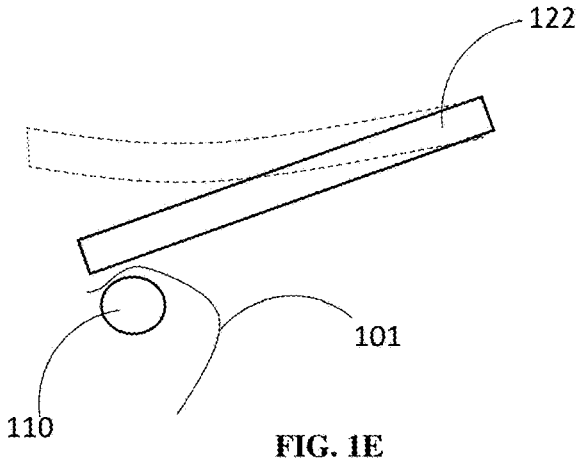
FIGS. 1E and F illustrate other embodiments of plungers in accordance with embodiments of the present disclosure.
Figure 1F:
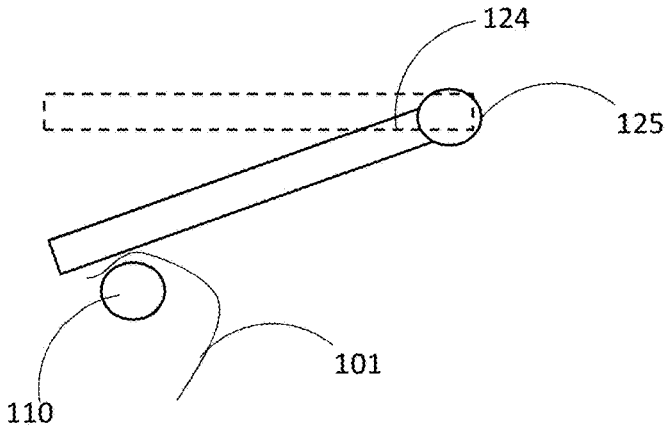
FIG. 1G illustrates another embodiment of the coiling apparatus in accordance with one embodiment of the present disclosure that uses an external rotary power source.

FIGS. 1E and F illustrate additional embodiments of plunger configurations that may be used in accordance with the present disclosure. In FIG. 1E, the plunger 122 is a solid elastic member that bends to accommodate the paper strip 101 as the paper strip 101 grows as a coil around the pin 110. The plunger 122 still translates toward and from the pin 100 and applies a compressive force that holds the paper strip 101 against the pin 110 In FIG. 1F, the plunger 124 is an arm or rod that pivots or rotate to accommodate the paper strip 101 as the paper strip 101 grows as a coil around the pin 110. The plunger 122 still translates toward and from the pin 100. A biasing element (not shown) may be used at the pivot joint 125 to apply a compressive force that holds the paper strip 101 against the pin 110.

Thus, it should be understood that, in the most general sense, a plunger as taught in the present disclosure is any member than can hold the paper strip 101 against the pin 110 and move away from the pin 110 as the paper coil grows. The plunger may use any type of movement (e.g., translational/linear, rotational, pivot, combinations thereof, etc.) and may or may not use a biasing force.

Figure 1G:
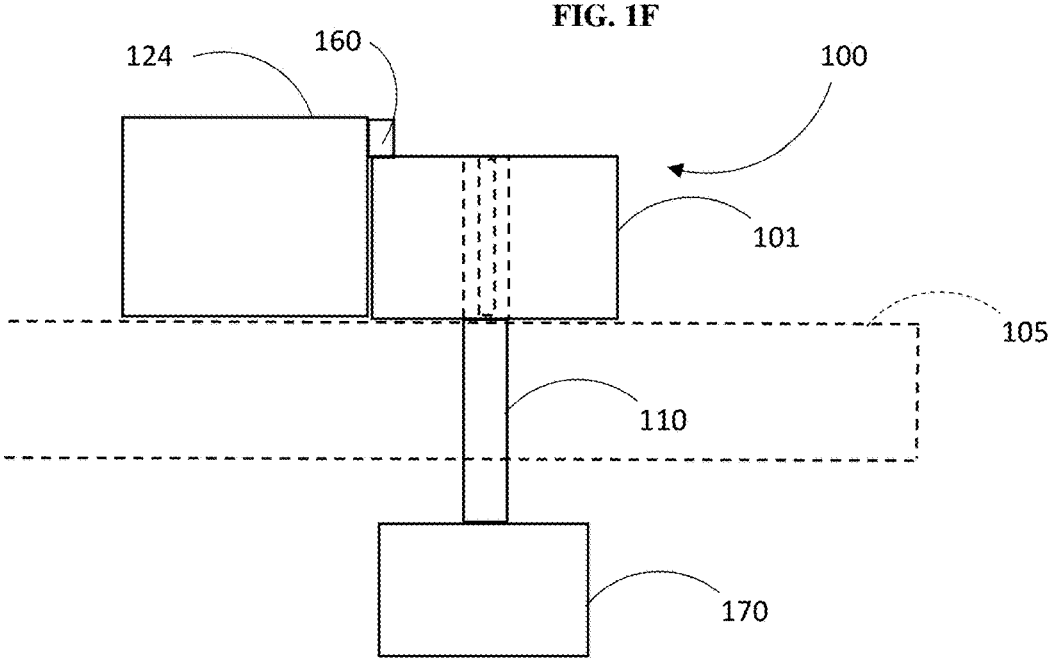

Referring to FIG. 1G, there is shown another embodiment of a coiling apparatus 100 according to the present disclosure. The FIG. 1G coiling apparatus 100 uses an external rotary power source 170. By "external," it is meant that the rotary power source 170 is outside of the housing 105 (shown in hidden lines) that serves as the platform for the pin 110 and the plunger 124. The plunger uses a single step 160 to confine the paper coil 101. The external power source 170 may use mechanical, electro-mechanical, pneumatic, hydraulic, or another form of actuation in order to deliver rotary power to the pin 110, which then allows the coil 101 to form. A mechanical rotary power source may be manual driven; e.g., rotated by hand. In one arrangement, the pin 110 may be configured to connect to and disconnect from the external rotary power source 170 when desired. Thus, the external power source 170 may be considered a separate component relative to the coiling apparatus 100.

To explain the operation of the coiling apparatus 100, consider that a user wishes to coil a paper strip. The user firstly pushes the plunger 120 backwards into the enclosure 125 by pressing on the plunger head 155, in order to create a gap between the plunger head 155 and the pin 110. Further, the user attaches or winds one end of the paper strip onto the pin 110. When the user pushes the plunger head 155 backwards, the compression spring 130 gets compressed against the closed end of the enclosure 125. Further, when the user releases his hand, the compression spring 130 exerts a restoring force on the plunger 120. Consequently, the plunger head 155 is pressed against the paper strip attached onto the pin 110.

After attaching the paper strip to the pin 110, the user actuates the driving element 115 in order to form the paper coil. Consequently, the pin 110 starts rotating causing the paper strip to create a paper coil around the pin 110. As the size of the paper coil increases, the plunger 120 is pushed further into the enclosure 125. This is because, as the radius of the paper coil increases, the effective torque exerted by the pin 110 on the plunger head 155 increases. Simultaneously, the compression spring 130 exerts a proportional restoring force on the plunger 120. This causes the paper coil to be held firmly in on the pin 110 during the coiling action. In other words, the plunger 120 prevents loosening of the paper coil during the coiling operation.

The coiling apparatus 100 disclosed herein addresses the shortcomings of conventional quilling tools. More specifically, the plunger head 155 provided in the coiling apparatus 100 avoids the need for a user to hold onto the paper strip during coiling. Further, the operation of the coiling apparatus 100 may be paused in order to add more strips. For example, in case of 3D quilling the user may add a multiple strips of different colors. In addition, the coiling apparatus 100 also makes it is easier to for the user to apply glue to the free end of the paper coil, in order to keep the paper coil tight.

Figure 2:
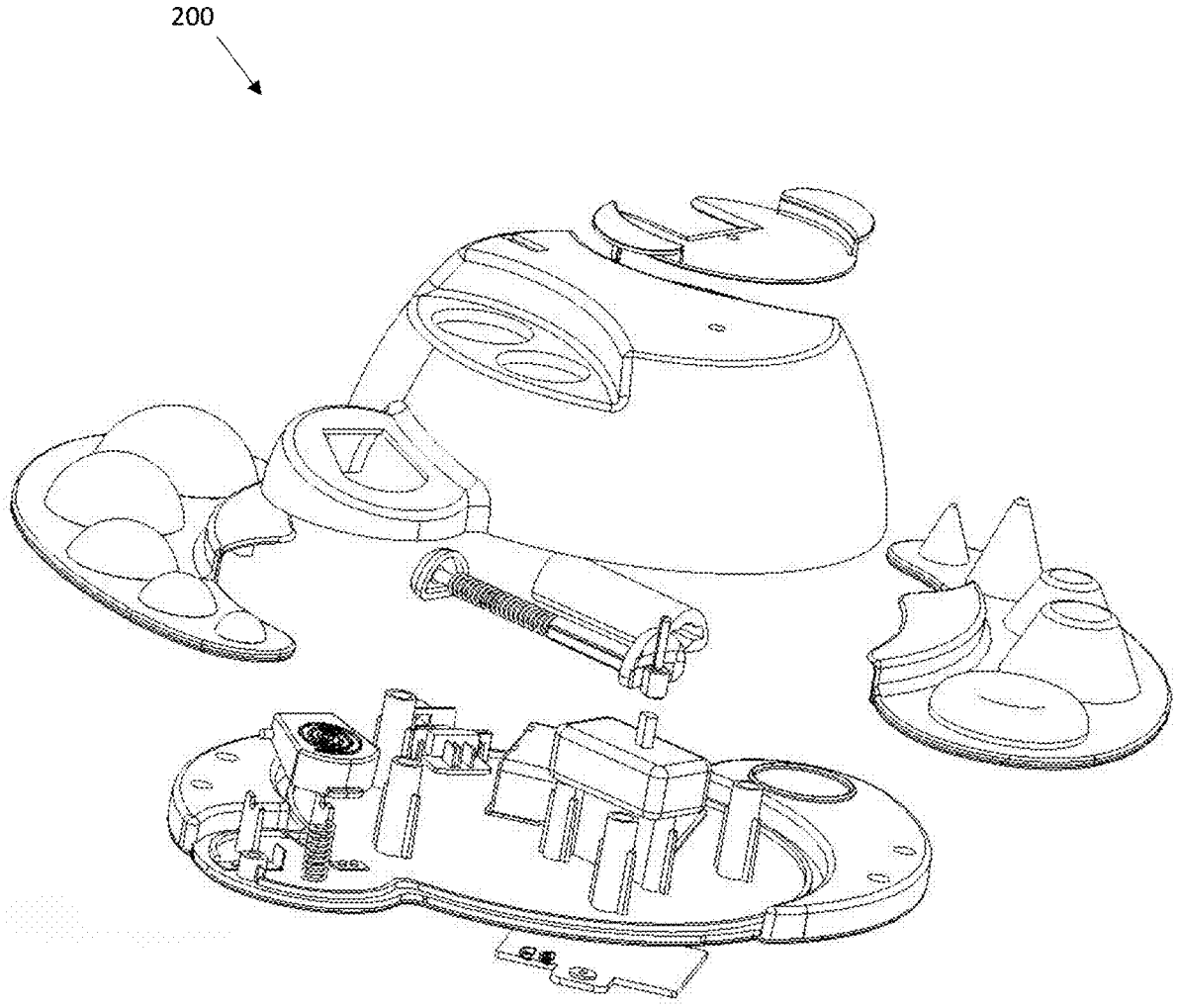
FIG. 2 illustrates a spyrostation, in accordance with one embodiment of the present disclosure.
Figure 3A:
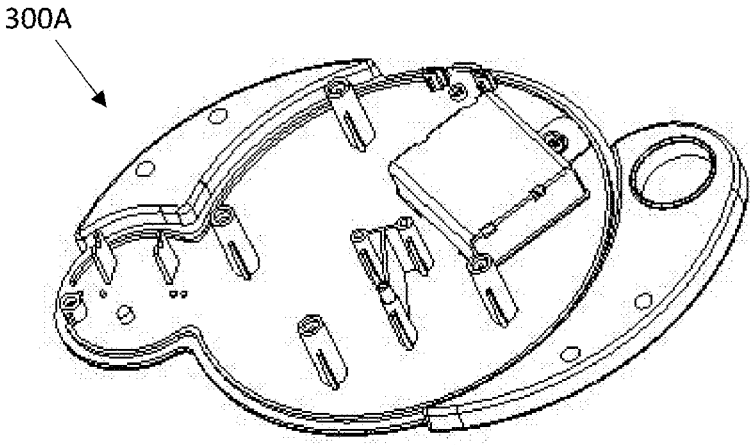
FIGS. 3A and 3B, illustrates a base and a top cover of the spyrostation of FIG. 2, in accordance with one embodiment of the present disclosure.
Figure 3B:
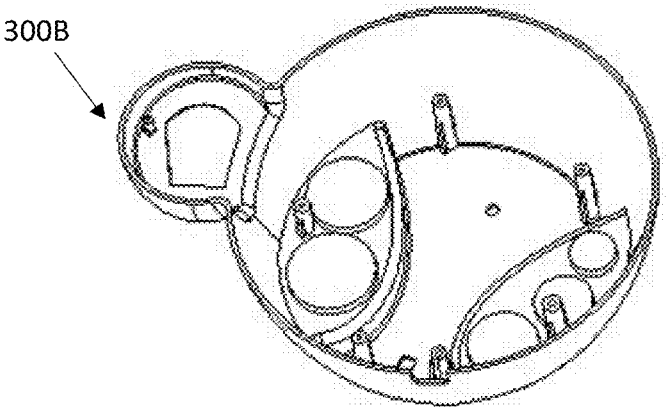
Figure 3C:
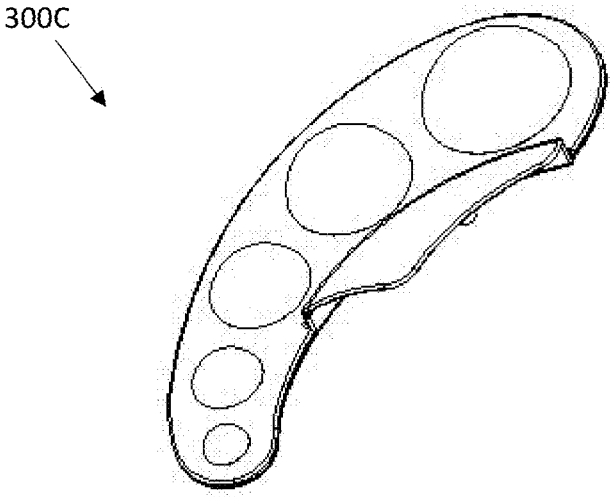
FIGS. 3C and 3D, illustrates a left mould and a right mould of the spyrostation of FIG. 2, in accordance with one embodiment of the present disclosure.
Figure 3D:
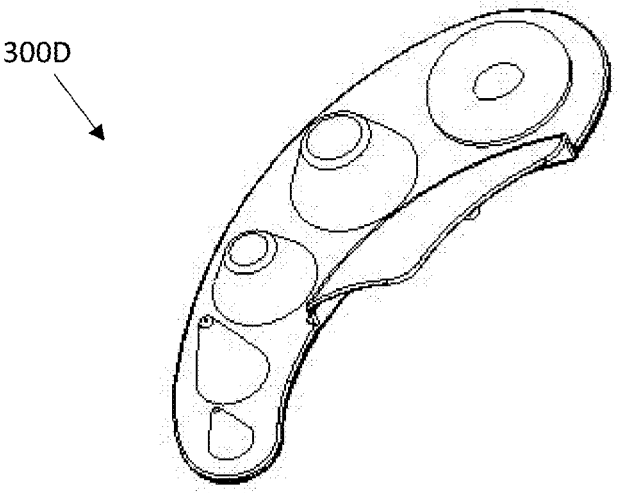
Figure 3E:
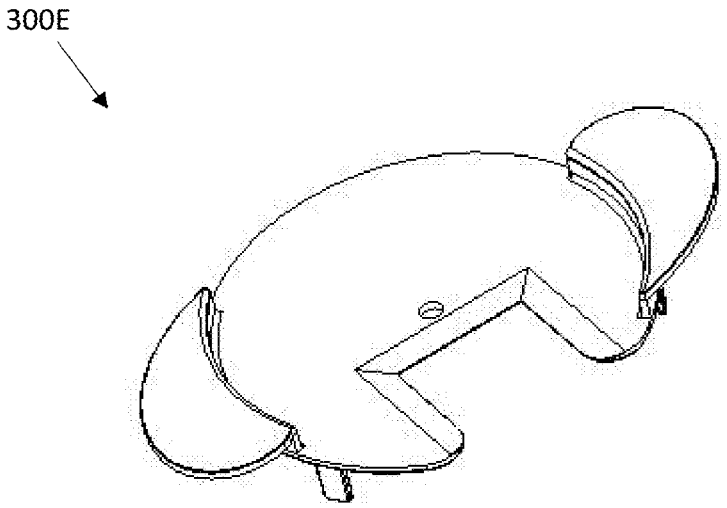
FIGS. 3E, 3F and 3G, illustrates a crinkle, a spring button and a pin of the spyrostation of FIG. 2, in accordance with one embodiment of the present disclosure.
Figure 3F:
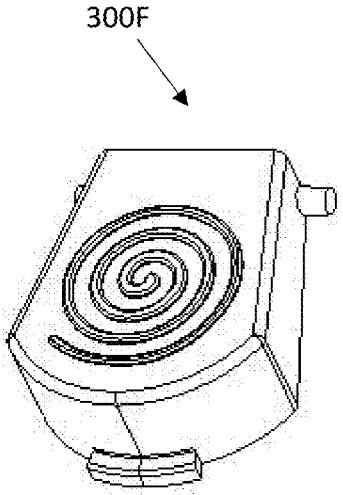
Figure 3G:
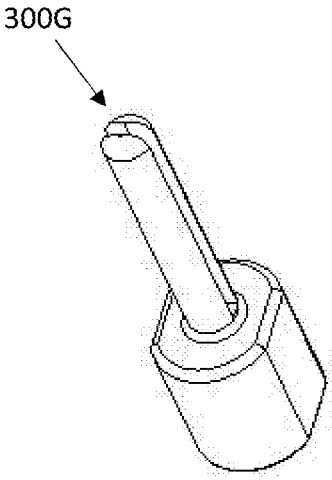

Referring to FIG. 2, a spyrostation 200 used in the coiling apparatus 100 for coiling a strip of paper is shown, in accordance with one embodiment of the present disclosure. The spyrostation 200 essentially comprises a base, a top cover, a left mould, a right mould, a crinkle, a crinkle lifter, a battery cover, a spring button, a pin, a switch button, a enclosure, a plunger, a stopper and a wire separator.

Referring to FIGS. 3A, 3B, 3C, 3D, 3E, 3F and 3G, several components of the spyrostation 200 are illustrated. The major components of spyrostation 200 are as shown by reference numeral as the base 300A, the top cover 300B, the left mould 300C, the right mould 300D, the crinkle 300E, the spring button 300F, the pin 300G.

To explain the operation of the spyrostation 200, consider that a user wishes to coil a paper strip. The user may attach the left mould 300C and right mould 300D. For example, the the left mould 300C and the right mould 300D may be used after the coil is made in order to give a 3D shape to the coil. Further, the user inserts the crinkle lifter on to the spyrostation 200. In one example, while using crinkles 300E, the user may use corrugated strip. The user inserts the corrugated strip into the pin 300G and press the button. The pressing of button initiates the driving element and the paper coil is made. Further, once the paper coil is made, the user may glue it. In one example, a self-adhesive strip may also be used for paper coiling and hence manually application of glue can be avoided. Further, once the paper coil is glued, the user may lift the coil along with the crinkle lifter. The left mould 300C or right mould 300D may be used to expand the coil.

Figure 4:
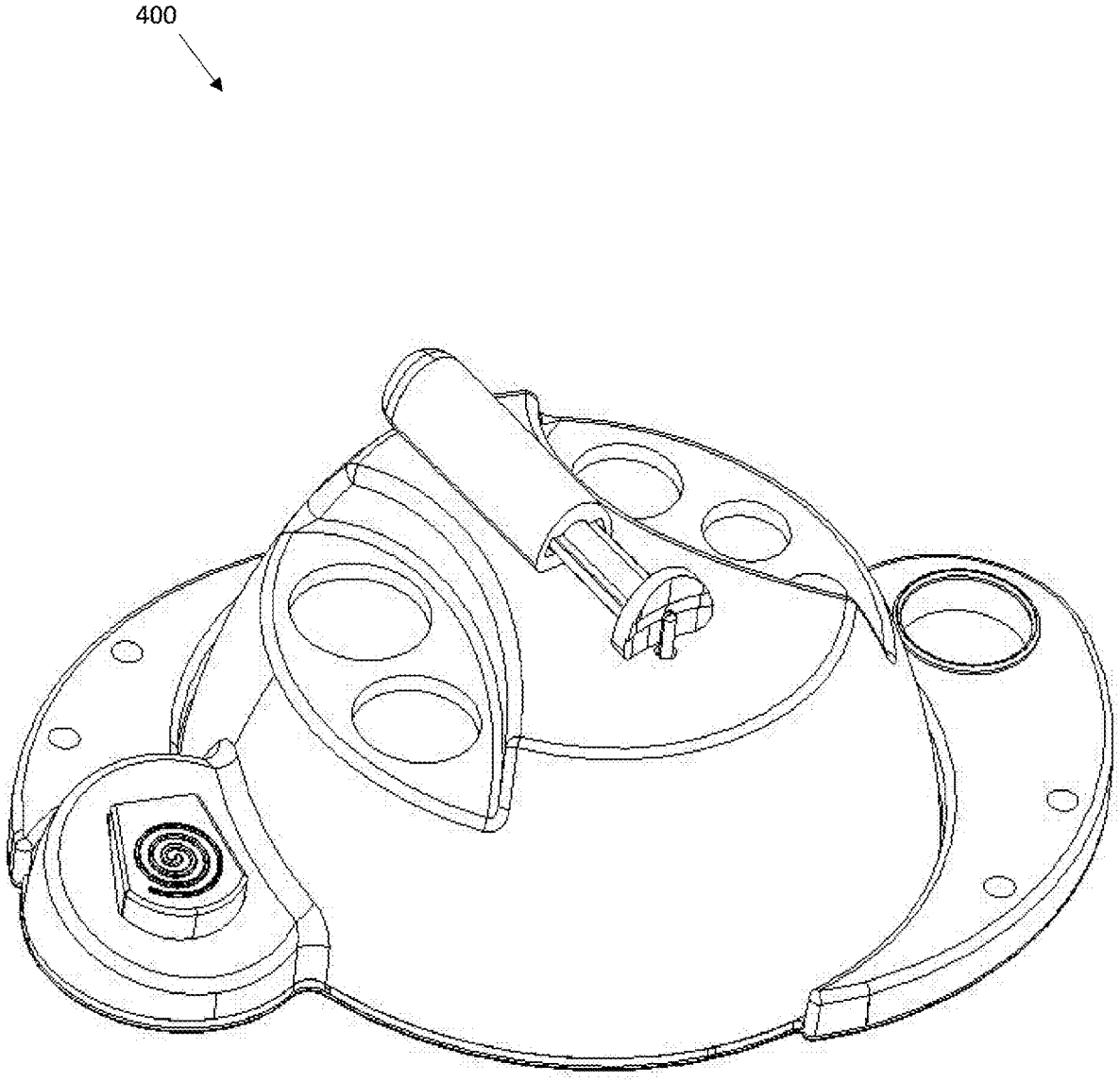
FIG. 4, illustrates a complete assembly of the spyrostation of FIG. 2, in accordance with one embodiment of the present disclosure.

Referring to FIG. 4, a complete assembly 400 of the spyrostation 200 used in coiling apparatus 100 for coiling a strip of paper is shown, in accordance with one embodiment of the present disclosure.

Figure 5:
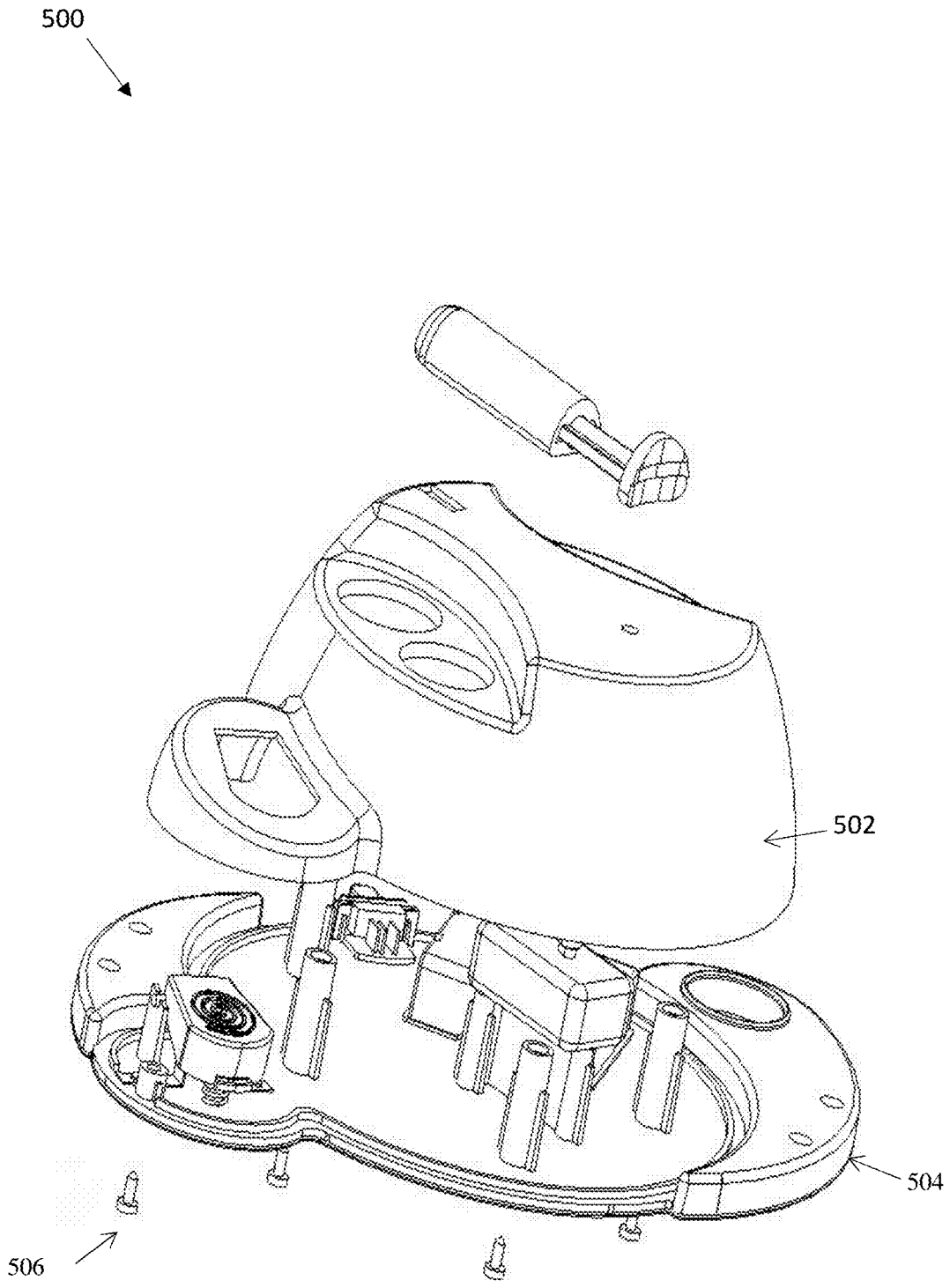
FIG. 5, illustrates an overall assembly of the spyrostation of FIG. 2, in accordance with one embodiment of the present disclosure.

Referring to FIG. 5, an overall assembly of the spyrostation 200 are shown, in accordance with one embodiment of the present disclosure. In the FIG. 3, a cover 502, a base 504, and plurality of screws 506 are illustrated. Furthermore, the essential internal components include compression spring, 3-way switch, motor, and switch plates.

Although in the present disclosure, the invention has been explained with regard to the formation of paper coils, it must be understood that the coiling apparatus may be used in any application that involves formation of coils. For example, the coiling apparatus may be used with fabric, leather, plastic and so on.

While specific language has been used to describe the disclosure, any limitations arising on account of the same are not intended. As would be apparent to a person skilled in the art, various working modifications may be made to the method in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

What is claimed is:

1. An apparatus for coiling a paper strip, the apparatus comprising:

a housing;

a pin having an end positioned external to the housing, the end having a slot elongated along an axis of rotation, the slot being sized to receive the paper strip;

an enclosure coupled to a surface of the housing, wherein the pin extends from the surface of the housing, and wherein the enclosure comprises a slot; and a plunger disposed on the housing, wherein the plunger comprises:

a portion having a protuberance, partially enclosed by the enclosure, wherein the portion is slidably coupled to the enclosure to linearly translate the plunger towards and away from the pin, wherein the protuberance and the slot of the enclosure are configured to prevent a rotary motion and restrict a distance of the linear translation of the plunger away from the pin; and a plunger head coupled to the portion of the plunger and positioned proximate to the pin, wherein the plunger head comprises a plunger surface aligned to press the paper strip against the pin, and wherein the plunger surface comprises a plurality of steps for accommodating paper strips having different widths, wherein each step comprises:

a surface portion extending parallel to the pin; and an edge extending perpendicular from a top end of the surface portion and aligned transverse to the pin, wherein the edge is configured to prevent the paper strip from uncoiling or moving upwards along the axis of rotation and away from the housing.

2. The apparatus of claim 1, wherein the enclosure comprises a compression spring to bias the plunger towards the pin.

3. The apparatus of claim 1, wherein the paper strip is confined between the at least one step and a surface of the housing.

4. The apparatus of claim 1, wherein the plunger is configured to translate away from the pin when a paper coil is formed on the rotating pin.

5. The apparatus of claim 1, further comprising:

a motor disposed in the housing and connected to the pin, the motor being configured to rotate the pin about the axis of rotation; and a switch positioned on the housing and configured to actuate the motor.

6. The apparatus of claim 5, wherein the motor is configured to generate torque to rotate the pin while the plunger head presses against the paper strip wound around the pin.

7. The apparatus of claim 1, further comprising: a rotary power source configured to rotate the pin about the axis of rotation, the rotary power source being external to the housing.

* * * * *